United States Patent [19]

Dahlstrom et al.

[11] Patent Number: 4,764,907

[45] Date of Patent: Aug. 16, 1988

[54] UNDERWATER TRANSDUCER

[75] Inventors: David K. Dahlstrom, Los Angeles; Merrill E. Fife, Canyon Country; Charles R. Judy, Newhall, all of Calif.

[73] Assignee: Allied Corporation, Morristown, N.J.

[21] Appl. No.: 860,361

[22] Filed: Apr. 30, 1986

[51] Int. Cl.[4] ..... H04R 17/00

[52] U.S. Cl. ..... 367/163; 367/155; 367/165; 310/337

[58] Field of Search ..... 367/155, 163, 165, 173, 367/174; 310/323, 324, 328, 334, 337, 354

[56] References Cited

U.S. PATENT DOCUMENTS

| | | | |
|---|---|---|---|
| 3,258,738 | 6/1966 | Merchant | 367/155 |
| 4,287,582 | 9/1981 | Tocquet | 367/155 X |
| 4,420,826 | 12/1983 | Marshall, Jr. et al. | 367/155 X |
| 4,462,093 | 7/1984 | Upton | 367/165 |

OTHER PUBLICATIONS

Royster, L., "The Flextensional Concept: A New Approach to the Design of Underwater Acoustic Transducers", *Applied Acoustics* vol. 3, No. 2, 1970.

*Primary Examiner*—Donald P. Walsh
*Assistant Examiner*—Ted L. Parr

[57] ABSTRACT

An underwater sonar transducer includes a centrally located beam with a plurality of stacks of piezoelectric transducer elements extending from each side, with a rigid end beam at the opposite end of each stack. A plurality of bolts extending from one end beam to the other on opposite sides of the stacks are tightened to apply a desired amount of prestress on the ceramic stacks. Arcuate radiating elements are welded to opposite sides of each end beam, end cap members are fastened to the centrally located beam at each end of the transducer and a jacket of elastomeric material is bonded to the edges of the end cap members to prevent ingress of fluid into the piezoelectric elements. Energizing of the piezoelectric elements causes expansion and contraction of the stacks, pushing the end beams in and out and causing bowing of the radiating elements to project sonar energy.

10 Claims, 2 Drawing Sheets

UNDERWATER TRANSDUCER

This invention relates to an underwater sonar transducer and more particularly to a type of sonar transducer known as a class IV flextensional transducer.

An underwater sonar transducer of the type described consists, in general, of a shell of some specified length which is hollow and of a generally elliptic cross section. The shell typically houses one or more stacks of piezoelectric ceramic elements and is designed to place a substantial compressive prestress on the ceramic elements. When an alternating voltage is placed on the piezo-electric elements, they expand and contract in such manner as to drive the narrow ends of the eliptical shell. This is transformed into large motions at the broad surfaces of the ellipse which are the major radiating surfaces.

Transducers of this general type are known and the elliptical shell may be of metal formed to the desired dimensions with the desired internal space for carrying the stack of ceramic piezoelectric members or it may be of a material such as glass fiber in an epoxy matrix. In either case, the one piece shell must be compressed significantly or flattened to increase the length of its hollow interior chamber so that the stack of ceramic elements can be inserted, after which the compressive force is removed, and the shell tends to return to its original shape, thus applying a static compressive prestress on the stack. In some cases spacers are used in combination with the stack to produce the desired interference fit. Because the ceramic material has very low strength in tension, it is necessary to bias the stack or stacks into a state of compression. During operation the stress on the ceramic material oscillates about its undriven compressive value. This value, however, varies with depth since water pressure on the elliptical shell tends to force the narrow ends outward, thus reducing the initial compressive prestress. As a result, the transducer is depth limited; i.e. at some depth the narrow ends of the shell will be displaced to the extent of removing the prestress altogether. This maximum depth can be adjusted by selecting the initial prestress, subject to the strengths of the materials used. The more prestress which exists at zero depth the deeper the transducer can operate before the interference tends toward zero. There is also a limit on the initial ceramic prestress since the ceramic material should not experience compressive stresses near its depoling stress limit. As a result, if the initial ceramic prestress is large to improve the maximum depth, a minimum operating depth may have to be observed. This occurs when the oscillating stress, due to energizing of the transducer elements causes the total ceramic stress, oscillating plus static, to dangerously approach its depoling value.

While the type of transducer described above is generally useful, there are some disadvantages to the structural arrangement described wherein the shell is of one piece. It will be apparent that it is difficult to design and build a shell and a transducer stack where the dimensions of each are such as to provide just the right amount of prestress on the ceramic stack. Also, this prestress must be evenly applied across the stack to avoid cracking or breaking the ceramic elements. Thus the single piece shell is quite expensive. The prestress desired tends to control the thickness of the shell and that thickness, in turn, affects the resonant frequency and thus limits the operating frequency range of the transducer.

Where deep depth operation is not a requirement, as in surface ship applications, an alternate transducer design which is the subject of this patent application, offers some significant advantages. In this design the shell is built as two separate half shells or radiating elements. The ceramic elements are fastened to opposite sides of a center beam and then prestressed by means of a plurality of stress bolts which are fastened to two very rigid end beams, one on each end of the ceramic stack, which the stress bolts are tightened against. Rigid members are required to minimize bending of the end beams which would result in uneven contact stress between the end beams and the ceramic elements, possibly resulting in fracturing of the ceramics when the stress bolts are tightened. Using this procedure, the prestressed ceramic stack or stacks exist as an independent assembly. The two half shells can then be attached with one edge fastened to each of said end beams, electron beam welded thereto, and the transducer is nearly complete. End caps of appropriate elliptical configuration are attached to the center and end beams and the entire assembly covered with a boot or jacket of appropriate elastomeric material.

An advantage of the above described construction is that, for metal shells, the construction of two half shells is less expensive than a single one piece shell. Another advantage is that since the shell itself is not required to apply the prestress force to the ceramic elements, the shell itself is not subjected to the prestress force when attached to the stack assembly. Therefore the shell thickness can be made as thin as necessary to control the resonant frequency of the device and keep weight to a minimum. A further advantage is that for thin-walled shells the use of the stress bolts provides for deeper depth capability than a corresponding one-piece shell without stress bolts since the prestress force can be more readily varied. Experimentation with the two half-shell design has demonstrated that, as compared with the one piece design of about the same area, the two half-shell design will operate at approximately one-half the resonant frequency, thus providing greater range.

Other features and advantages will appear from the following description and the accompanying drawings in which.

Figure 1:
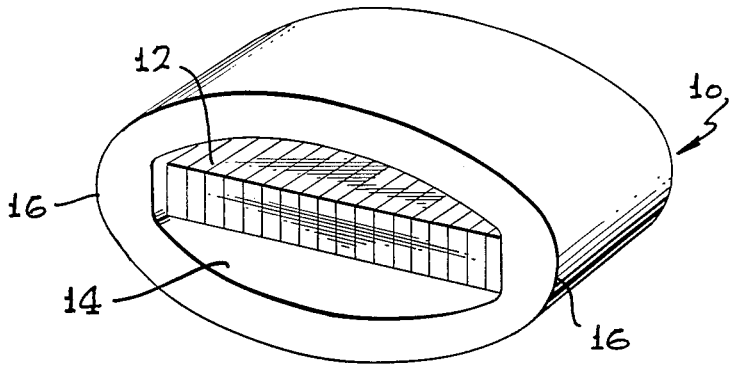
FIG. 1 PRIOR ART
FIG. 1 is a schematic view, partly in perspective, of a prior art type of flextensional transducer using a single piece shell as described above.

Referring now to FIG. 1, a generally elliptical shell 10 of a desired length is formed of steel, or it may be of glass fiber in an epoxy matrix as described above. This shell of necessity has walls of some thickness since its internal chamber must house a stack of ceramic piezoelectric elements 12 in such way as to apply a substantial compressive prestress on the stack. When the stack 12 is assembled it will be slightly longer than the major diameter of the elliptical opening 14 of shell 10. To assemble this transducer it is necessary to apply a substantial compressive force across the minor diameter of the shell 10 forcing the narrow ends 16 to move outwardly, thus increasing the major diameter of the elliptical opening sufficiently to permit the stack 12 to be inserted into the opening. When the force is removed, the shell 10 will tend to return to its original configuration which it cannot quite do because of the interference fit with the stack 12. The dimensions of shell 10 and stack 12 must, of course, be carefully calculated to provide the desired amount of prestress and an even amount of prestress across the stack to avoid cracking the ceramic elements. Since the wall thickness of shell 10 is related to this prestress, it also tends to control the reasonant frequency and the frequency bandwidth of the transducer.

Figure 2:
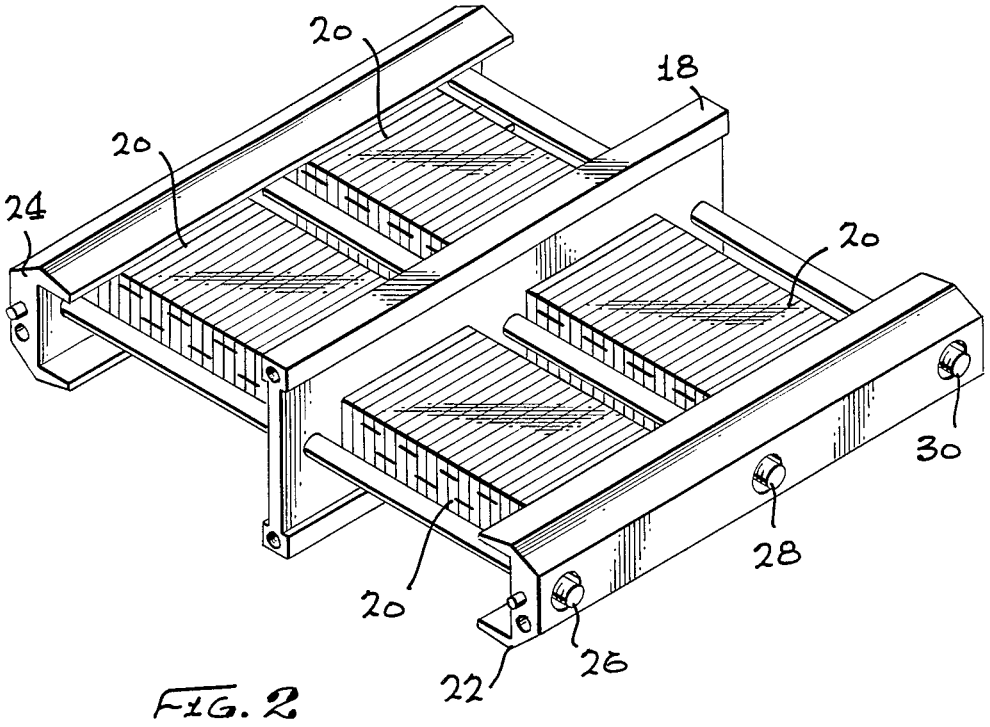
FIG. 2 is a perspective view of a pre-stressed ceramic stack made according to our invention prior to assembly of the half shells.

FIG. 2 is a perspective view of an assembled prestressed ceramic stack according to our invention prior to attachment of the half shells. In this view will be seen a center beam 18 having two stacks 20 of ceramic piezoelectric elements bonded to each side and spaced from each other. The stacks are formed with a group of ceramic piezoelectric elements (in this case 16) plus one unpolarized element bonded together and the stack is carefully formed with the unpolarized element ground such that the height of the stacks are within a close tolerance of each other. The rigid end beam members 22 and 24 are then fastened to the outboard ends of the stacks 20 by means of three stress bolts 26, 28 and 30 with bolt 28 being located in the center of the assembly so that it is physically between both stacks on each side of center beam 18. It will be noted that all of beams 18, 22 and 24 are drilled to receive the stress bolts. One of the most critical parts of the assembly is tightening of the nuts on the stress bolts to impart the desired prestress on the ceramic stacks 20 because of the inherent brittleness of the ceramic material and the fact that it should not be subjected to any significant bending stress. The stacks 20 are somewhat expensive to produce and if an element is cracked or chipped during assembly, the entire stack must be discarded and replaced. To ensure that the bolts 26, 28 and 30 are pulled up evenly, strain gages are preferably attached to each bolt and connected to instrumentation to that slight differences in tension on the bolts will be observed. This, of course, also provides a means for knowing when the desired compressive prestress has been applied to the stacks 20. The ceramic elements in stacks 20 are all electrically interconnected, of course, and electrical connections made from the stacks 20 to a suitable driving amplifier (not shown) but such electrical connections are well within the state of the art and understood by those working in the field. They form no part of the present invention.

Figure 3:
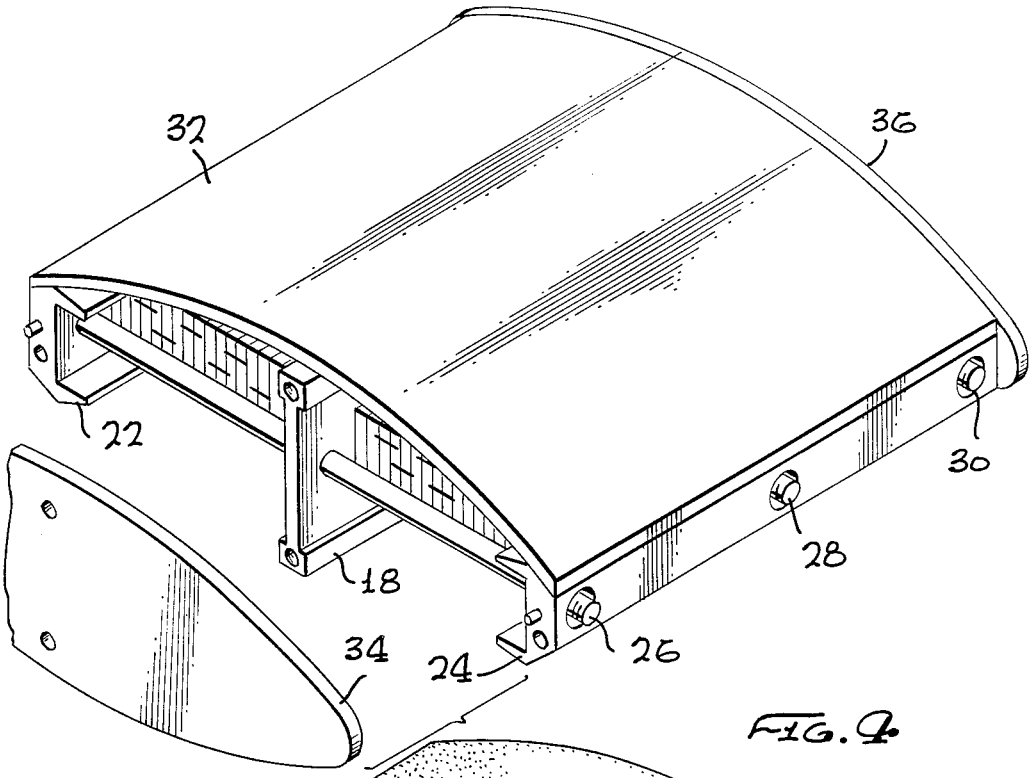
FIG. 3 is a perspective view of an assembly similar to FIG. 2 but with one half shell attached and showing endcaps ready for mounting.

FIG. 3 shows a successive step in the assembly of the transducer. The assembly of FIG. 2 has been completed and forms a rigid unitary structure ready for attachment of the half shells. In FIG. 3, one of the half shells 32 is shown in position with its edges electron beam welded to the end beams 22 and 24. A pair of end caps 34 and 36 are shown ready to be bolted to the ends of beam 18.

Figure 4:
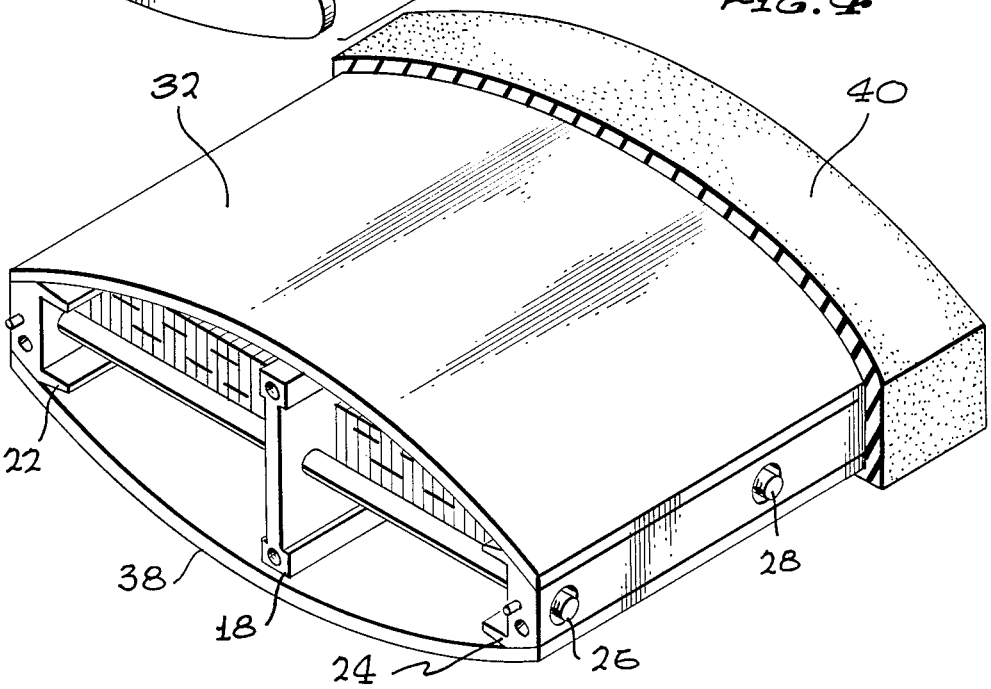
FIG. 4 is a perspective view similar to FIG. 3 but with both half shells attached.

FIG. 4 is a perspective view of a transducer according to our invention which is that of FIG. 3 but with both half shells 32 and 38 electron beam welded to the end beams to form a completed elliptical shell. When the assembly has been completed to this extent, all that remains is to bolt the endcaps to beam 18, cover the half shells with a jacket or boot 40 of neoprene or other suitable elastomeric material which is acoustically essentially transparent. This jacket is sealed to the edges of the endcaps 34 and 36.

Operation of the transducer is essentially as described above, the expansion and contraction of the stacks 20 is transferred to the end beams 22 and 24 causing them to move in and out. As they move, they cause the half shells 32 and 38 to bow outwardly greater or lesser amounts, causing sonic waves in the surrounding water. It has been found that the above described construction permits the use of half shells of substantially less thickness than would be required for one piece shells, and this permits operation at much lower frequencies than is possible with a comparable transducer with a one piece shell. It will be appreciated by those skilled in the art that several variables of construction are easier to control with our two half shell design; e.g. the prestress on the stacks can be more easily controlled; the thickness of the half shells is no longer related to the prestress so that broader frequency bandwidths and lower frequencies (resulting in greater range) become possible, and the entire transducer has less weight and becomes less expensive to produce, at least as compared with an all-metal single shell design.

We claim:

1. An underwater flextensional sonar transducer including a hollow shell of elliptic cross section and a stack of piezo-electric transducer elements placed in said shell such that, when energized, they tend to vibrate along the major axis of said shell, characterized in that said transducer comprises a rigid end beam at each end of said stack with bolts connected between said end beams and tightened to produce a desired amount of compressive presetress in said stack, a pair of arcuate radiating elements, each having one edge fastened to one of said end beams and another edge fastened to the other of said end beams such that expansion and contraction of said stack when energized is transformed into large motions of said arcuate radiating elements, cap members extending between the ends of said end beams, and a jacket of elastomeric material covering said cap members, said end beams and said radiating elements.

2. An underwater sonar transducer as claimed in claim 1 wherein said stack of transducer elements includes at least two separate groups of piezoelectric elements with said bolts connected between said groups and at the outside of said groups.

3. An underwater sonal transducer as claimed in claim 1 wherein said transducer includes a third beam located between said end beams, and said stack includes equal numbers of said groups of piezoelectric elements carried on opposite sides of said third beam.

4. An underwater sonar transducer as claimed in claim 1 wherein the edges of said arcuate radiating elements are welded to said end beams.

5. An underwater sonar transducer as claimed in claim 1 wherein said compressive prestress is maintained at a value which, when added to oscillating stress resulting from energizing said stack, is significantly less than that which would depole said transducer elements.

6. An underwater sonar transducer as claimed in claim 1 wherein said transducer includes a third beam located between said end beams and said stack of transducer elements includes at least two separate groups of piezoelectric elements, said groups being evenly divided on opposite sides of said third beam.

7. An underwater sonar transducer as claimed in claim 1 wherein said arcuate radiating elements are not prestressed.

8. An underwater flextensional sonar transducer including a hollow shell of generally elliptic cross-section, a stack of piezoelectric transducer elements placed in said shell such that, when energized, they vibrate along the major axis of said shell, and means for exerting a compressive static force on said stack characterized in that said transducer comprises a center beam in said shell, said stack includes an even number of groups of piezoelectric elements with half of said groups on each side of said center beam, a pair of rigid end beams in contact with the outside ends of said groups, a plurality of stress bolts extending between said end beams such that, when tightened, a desired compressive force is substantially evenly placed on said groups, a pair of radiating elements of arcuate cross-section, each of which is fastened at one of its edges to one of said end beams and at its opposite edge to the other of said beams such that when said stack is energized by means of an alternating current, said end beams are caused to move toward and away from said center beam causing large motions of said arcuate radiating elements, generally elliptically shaped cap members fastened to the ends of said beams, and a jacket of elastomeric material covering said radiating elements and said end beams and sealed to said cap members for preventing entry of water into said shell.

9. An underwater sonar transducer as claimed in claim 8 wherein one of said stress bolts is placed on each side of each of said groups of piezoelectric elements to provide a means for prestressing said elements substantially evenly.

10. An underwater sonar transducer as claimed in claim 8 wherein the edges of said arcuate radiating elements are electron-beam-welded to said end beams.

* * * * *